US011192042B2

(12) United States Patent
Hawkins

(10) Patent No.: US 11,192,042 B2
(45) Date of Patent: Dec. 7, 2021

(54) PLUSH TOY SYSTEM

(71) Applicant: Bret Hawkins, Highlands Ranch, CO (US)

(72) Inventor: Bret Hawkins, Highlands Ranch, CO (US)

( * ) Notice: Subject to any disclaimer, the term of this patent is extended or adjusted under 35 U.S.C. 154(b) by 0 days.

(21) Appl. No.: 16/832,342

(22) Filed: Mar. 27, 2020

(65) Prior Publication Data

US 2020/0324216 A1 Oct. 15, 2020

Related U.S. Application Data

(60) Provisional application No. 62/831,536, filed on Apr. 9, 2019.

(51) Int. Cl.
*A63H 3/02* (2006.01)
*A63H 3/00* (2006.01)

(52) U.S. Cl.
CPC ..... *A63H 3/02* (2013.01); *A63H 3/003* (2013.01)

(58) Field of Classification Search
CPC .. A63H 3/003; A63H 3/02; A63H 3/36; Y10S 446/901
USPC ..... 446/369, 901
See application file for complete search history.

(56) References Cited

U.S. PATENT DOCUMENTS 3,370,853 A * 2/1968 Feld ..... A63B 43/005 473/573
3,789,547 A * 2/1974 Chemarin ..... A63H 3/02 446/369
3,889,414 A * 6/1975 Whetzel ..... A63H 3/44 446/394
4,122,628 A * 10/1978 Crowell ..... A63H 3/02 446/100
4,170,086 A * 10/1979 Hills ..... A63H 3/02 428/100
4,197,670 A * 4/1980 Cox ..... A63H 3/008 434/273
4,235,042 A * 11/1980 Hills ..... A63H 3/14 446/327
4,504,240 A * 3/1985 Thomas ..... A63H 3/365 446/100
4,540,378 A * 9/1985 Cusimano ..... A63H 3/02 428/100
4,543,278 A * 9/1985 Ackerman ..... A63H 33/00 248/205.2
4,543,669 A * 10/1985 Katz ..... A41D 11/00 2/84
4,579,537 A * 4/1986 Leahy ..... A63F 9/12 446/100

(Continued)

*Primary Examiner* — Alexander R Niconovich
(74) *Attorney, Agent, or Firm* — Sheridan Ross P.C.

(57) ABSTRACT

A plush toy system is provided that can be selectively securable to an object. The system may comprise a main body comprising a fabric cover at least partially defining an enclosed area. A first portion of the fabric cover may comprise a first connectable fabric operable to releasably attach to a second connectable fabric. The system may include a label having a first section fixed to the fabric cover and a second section removably coupled to the fabric cover. The system may also include a second portion comprising a first side and an opposing second side. The second side may comprise the second connectable fabric. The toy may be releasably coupled to the second portion when the first connectable fabric of the fabric cover is joined to the second connectable fabric.

17 Claims, 4 Drawing Sheets

(56) References Cited

U.S. PATENT DOCUMENTS 4,595,618 A * 6/1986 Caringer ..... A63H 3/00 280/801.1
4,671,514 A * 6/1987 Wilson-Diehl ..... A63F 3/00094 273/240
4,729,751 A * 3/1988 Schiavo ..... A63H 3/36 446/268
4,762,494 A * 8/1988 Woods ..... G09B 23/28 434/236
4,822,285 A * 4/1989 Summerville ..... A63H 3/003 434/272
4,856,131 A * 8/1989 Mills ..... A63H 3/003 5/413 R
4,979,924 A * 12/1990 Manger ..... A63H 3/16 428/100
5,059,149 A * 10/1991 Stone ..... A63H 3/003 446/73
5,071,385 A * 12/1991 Cox ..... A63H 3/02 446/129
5,090,935 A * 2/1992 Monson ..... A63F 9/12 273/157 R
5,097,854 A * 3/1992 Smith ..... A45D 8/34 132/275
5,326,300 A * 7/1994 Sonders ..... A45C 15/00 190/1
5,551,687 A * 9/1996 Krull ..... A63B 43/007 473/573
5,561,864 A * 10/1996 DeMars ..... A42B 1/004 2/209.13
5,749,764 A * 5/1998 Bailey ..... A63H 3/005 446/302
5,807,112 A * 9/1998 Zeck ..... G09B 19/0092 434/127
5,897,421 A * 4/1999 Rink ..... G09B 1/32 446/369
6,010,387 A * 1/2000 Nemec ..... A63H 3/10 428/100
6,120,340 A * 9/2000 Zaborowski ..... A63H 3/44 446/100
6,279,167 B1 * 8/2001 Johnson ..... A42B 1/004 2/209.11
6,421,852 B1 * 7/2002 Shao ..... A63H 3/005 446/73
6,623,328 B1 * 9/2003 Theel ..... A01K 15/026 119/707
6,676,478 B1 * 1/2004 Starner ..... A63F 9/02 273/348.4
6,848,967 B2 * 2/2005 Kim ..... A63H 3/02 446/369
8,062,087 B1 * 11/2011 Davis ..... A63H 3/14 446/26
8,196,225 B1 * 6/2012 Nicks ..... A41D 27/08 2/244
8,946,945 B2 * 2/2015 Chu ..... A63H 3/02 307/125
9,573,073 B1 * 2/2017 Mazur ..... A63H 33/004
9,724,614 B2 * 8/2017 Karsten ..... A63H 3/14
9,878,256 B2 * 1/2018 Jones ..... A63H 3/003
9,931,579 B1 * 4/2018 Garcia ..... A63H 37/00
10,500,512 B2 * 12/2019 Culver, II ..... A63H 3/005
2006/0205319 A1 * 9/2006 Colvin ..... A63H 3/005 446/369
2009/0068922 A1 * 3/2009 Brielmann ..... A63H 3/02 446/268
2010/0048088 A1 * 2/2010 Cardinale ..... A63H 3/02 446/98
2011/0117809 A1 * 5/2011 Bowar ..... A63H 3/02 446/369
2012/0264349 A1 * 10/2012 Ciampitti ..... A63H 3/02 446/369
2012/0329358 A1 * 12/2012 Cupid ..... A63H 3/005 446/73
2016/0151717 A1 * 6/2016 Mathews ..... A63H 3/02 446/369
2016/0199745 A1 * 7/2016 Powell ..... A63H 3/02 446/73

* cited by examiner

PLUSH TOY SYSTEM

This U.S. Non-Provisional patent application claims the benefit of priority of U.S. Provisional Patent Application Ser. No. 62/831,536, filed Apr. 9, 2019, the entire disclosure of which is hereby incorporated by reference.

FIELD

The present disclosure relates generally to systems for selectively securing a plush toy to an object. In various embodiments, plush toys of the present disclosure comprise a first connectable fabric and second portions of the present disclosure comprise a second connectable fabric operable to be releasably connected to the first connectable fabric.

BACKGROUND

Plush toys provide many benefits including providing comfort, entertainment, and enjoyment to users, particularly children. Conventional plush toys are made of a variety of fabrics. However, such fabrics are typically non-functional, which may limit the user experience to static activities, e.g., holding, hugging, and/or resting with the plush toy. Further, conventional plush toys may be a collectible toy, which may be designated on an external paper-based label fastened to the toy. Such label may be perishable and easily detach from the toy.

SUMMARY

There is an unmet need to provide a plush toy system that includes functional properties that allow for customization of the plush toy and/or objects and a permanent and reliable label for the plush toy. Accordingly, embodiments of the present disclosure contemplate and provide systems for selectively securing a plush toy to an object. In various embodiments, a main body comprising a fabric cover at least partially defining an enclosed area is provided. In various embodiments, a first portion of the fabric cover comprises a first connectable fabric operable to releasably attach to a second connectable fabric. The enclosed area comprises a fill material including, but not limited to: polyester fiberfill, plastic pellets, stuffing, or the like. Embodiments of the present disclosure also comprise a label having a first section fixed to the fabric cover and a second section removably coupled to the fabric cover. An interior surface of the label is covered when the second section is coupled to the cover and the interior surface is uncovered when the second section is uncoupled from the cover. Embodiments of the present disclosure also comprise a second portion comprising a first side and an opposing second side. The first side comprises an adhesive to selectively secure the second portion to an object. The second side comprises the second connectable fabric. The toy is releasably coupled to the second portion when the first connectable fabric of the fabric cover is joined to the second connectable fabric.

In various embodiments, a main body comprising a fabric cover at least partially defining an enclosed area is provided. A first portion of the fabric cover comprises a first connectable fabric operable to releasably attach to a second connectable fabric. The first portion comprising the first connectable fabric comprises at least fifteen percent of a surface area of the fabric cover. The enclosed area comprises a fill material including, but not limited to: polyester fiberfill, plastic pellets, stuffing, or the like. Embodiments of the present disclosure also comprise an object comprising a second portion. The second portion comprises the second connectable fabric. The toy is releasably coupled to the second portion when the first connectable fabric of the fabric cover is joined to the second connectable fabric.

In various embodiments, a main body comprising a fabric cover at least partially defining an enclosed area is provided. A first portion of the fabric cover comprises a first connectable fabric operable to releasably attach to a second connectable fabric. The enclosed area comprises a fill material including, but not limited to: polyester fiberfill, plastic pellets, stuffing, or the like. Embodiments of the present disclosure also comprise a label having a first section fixed to the fabric cover and a second section removably coupled to the fabric cover. An interior surface of the label is covered when the second section is coupled to the cover and the interior surface is uncovered when the second section is uncoupled from the cover.

This Summary is neither intended nor should it be construed as being representative of the full extent and scope of the plush toy system of the present disclosure. The present disclosure is set forth in various levels of detail in the Summary as well as in the attached drawings and the Detailed Description and no limitation as to the scope of the present invention is intended by either the inclusion or non-inclusion of elements or components. Additional aspects of the present invention will become more readily apparent from the Detailed Description, particularly when taken together with the drawings.

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

The term "a" or "an" entity, as used herein, refers to one or more of that entity. As such, the terms "a" (or "an"), "one or more," and "at least one" can be used interchangeably herein. The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

BRIEF DESCRIPTION OF THE DRAWINGS

The accompanying drawings, which are incorporated in and constitute a part of the specification, illustrate embodiments of the invention and together with the Summary given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

DETAILED DESCRIPTION

Figure 1B:
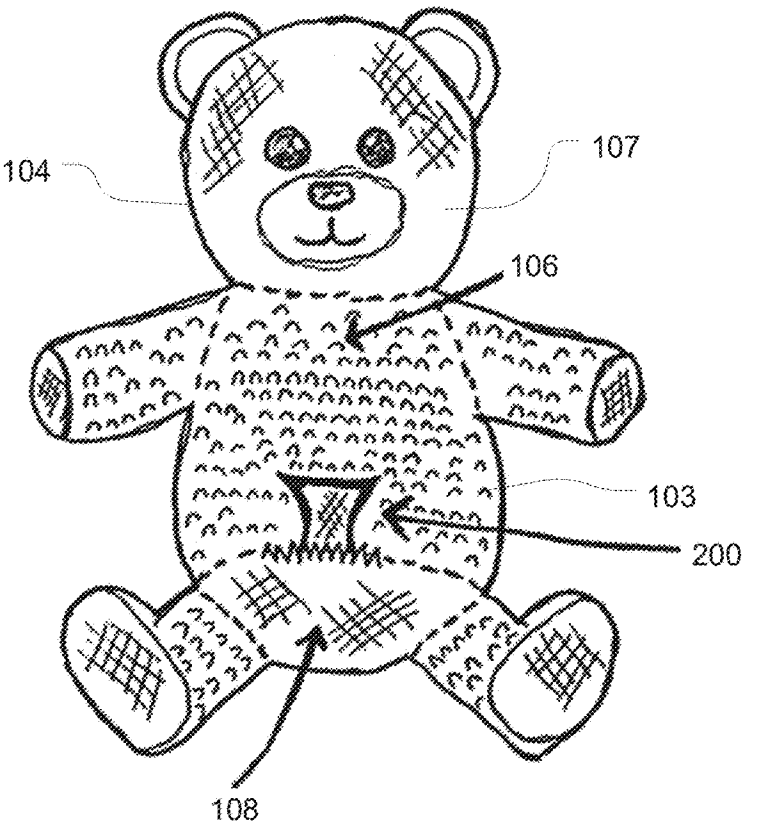
FIG. 1B is a front elevation view of a plush toy of the plush toy system of the embodiment of FIG. 1A.
Figure 1A:
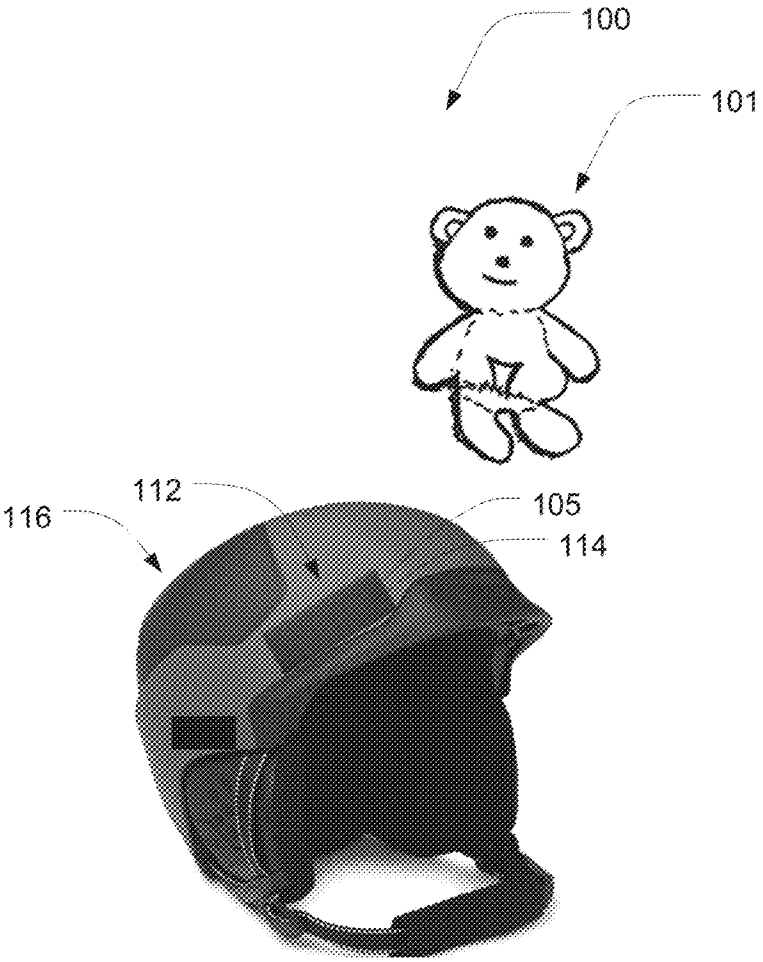
FIG. 1A is a front exploded perspective view of a plush toy system according to one embodiment of the present disclosure.

FIG. 1A is an exploded perspective view of a plush toy system 100 according to one embodiment of the present disclosure. FIG. 1B is a front elevation view of a plush toy 101 of the plush toy system 100 of FIG. 1A. The plush toy 101 comprises a main body 102 having a fabric cover 104 at least partially defining an enclosed area. The enclosed area comprises a fill material including, but not limited to, polyester fiberfill, plastic pellets, stuffing, beads, feathers, or the like. In various embodiments, the fill material provides for flexibility in the plush toy 101. In alternative embodiments, the plush toy 101 comprises a rigid or substantially rigid device. For example, it is contemplated that at least a portion of the device comprises a rigid or semi-rigid material including, for example, a rubber or plastic. In various embodiments, the main body 102 is one continuous fabric cover 104. Alternative embodiments contemplate the main body 102 comprising multiple pieces, e.g., appendages. The main body 102 is sewn, adhered, stapled, or the like to enclose the enclosed area. The main body 102 is formed into any shape or figure. In the illustrated example, the main body 102 is shaped as a bear. In other examples, the main body 102 is shaped as any animal, humanoid, or object.

A first portion 106 of the fabric cover 104 comprises a first connectable fabric 103 operable to releasably attach to a second connectable fabric 105. Each of the first connectable fabric 103 and the second connectable fabric 105 is at least one of a hook fabric or a loop fabric. The hook fabric and the loop fabric are removably coupled when brought together and detachable when pulled apart. In various embodiments, the first connectable fabric 103 is comprised of the loop fabric and the second connectable fabric 105 is comprised of the hook fabric. In other examples, the first connectable fabric 103 is comprised of the hook fabric and the second connectable fabric 105 is comprised of the loop fabric. Alternative embodiments contemplate the first connectable fabric 103 and/or the second connectable fabric 105 comprising a combination of the hook fabric and the loop fabric.

A remaining portion 108 of the fabric cover 104 comprises a static fabric 107 including, but not limited to, plush, mohair, cotton, or other similar fabrics or a combination of fabrics. In some embodiments, the first portion 106 is sewn in place with the remaining portion 108. Alternative embodiments contemplate the first portion 106 sewn on top of, or otherwise attached, to the remaining portion 108. In other words, the fabric cover 102 is either one layer comprising both the first portion 106 in line with the remaining portion 108 or the fabric cover 102 includes two or more layers comprising the first portion 106 attached to an external surface of the remaining portion 108. In various examples, the first portion 106 is at least fifteen percent of a surface area of the fabric cover 104. In other examples, the first portion 106 is less than fifteen percent of the surface area. In other words, the fabric cover 104 may comprise fifteen percent, more than fifteen percent, or less than fifteen percent of the first connectable fabric 103 (e.g., hook fabric or loop fabric). In some embodiments, the first portion 106 is segmented amongst the surface area of the fabric cover 104 and comprise multiple portions. Alternative embodiments contemplate the first portion 106 comprising one portion.

Figure 2B:
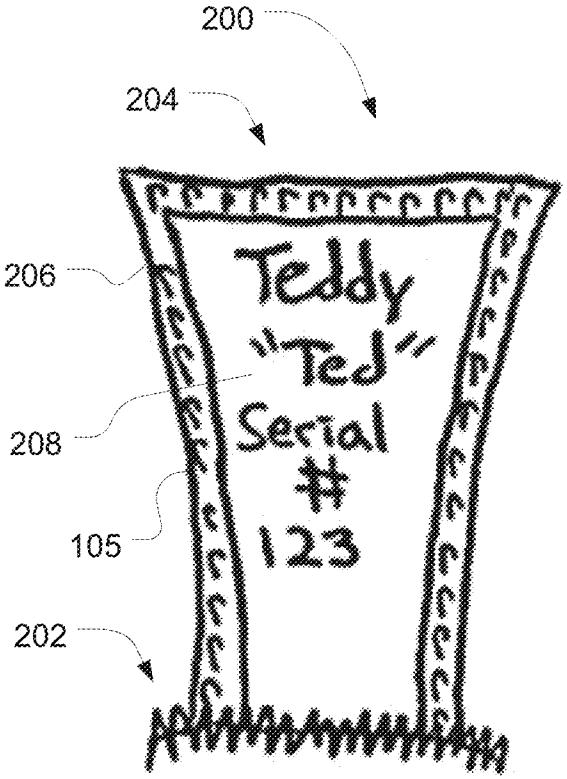
FIG. 2B is a front elevation view of the label of the embodiment of FIG. 1A.
Figure 2A:
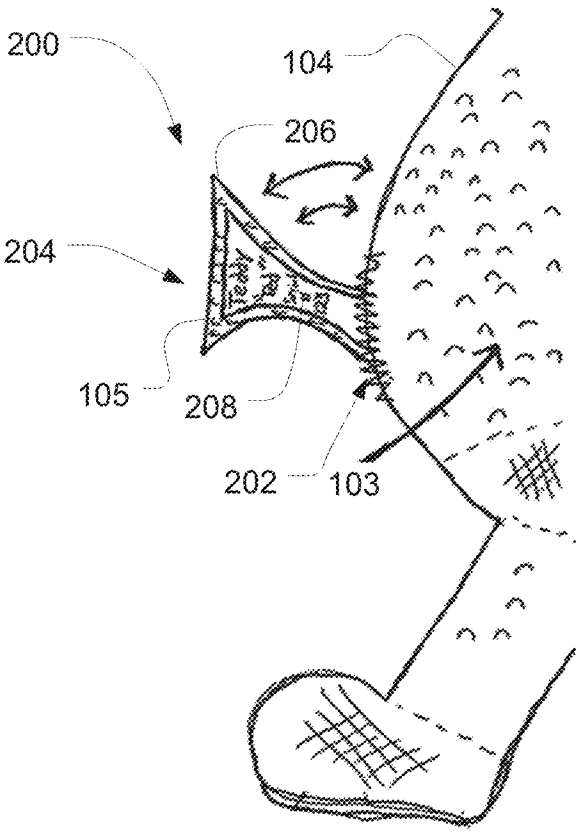
FIG. 2A is a top elevation view of a label of the plush toy system of the embodiment of FIG. 1A.

FIG. 2A is a top elevation view of a label 200 (also visible in FIG. 1B) of the plush toy system of the embodiment of FIG. 1A. FIG. 2B is a front elevation view of the label 200 of the embodiment of FIG. 1A. The label 200 comprises a first section 202 fixed to the fabric cover 104 and a second section 204 removably coupled to the fabric cover 104. In the illustrated example, the label 200 is fixed to a front portion of the fabric cover 104. Alternative embodiments contemplate the label 200 being fixed to any portion of the fabric cover 104. The first section 202 is stitched, adhered, or otherwise fixed to the fabric cover 104. The second section 204 comprises the second connectable fabric 105 for removably coupling to the first portion 106 of the main body 102. In some embodiments the second section 204 comprises the hook fabric and the first portion 106 comprises the loop fabric. Alternative embodiments contemplate the second section 204 comprising the loop fabric and the first portion 106 comprising the hook fabric. In other embodiments, the first section 202 is a portion of a perimeter 206 of the label 200 that fixed to the fabric cover 104 and the second section 204 is a remaining portion of the perimeter 206 of the label 200. In other embodiments, the second section 204 comprises a portion of the label 200. Further, in other embodiments the second section 204 comprises the remaining portion of the label 200 aside from the first section 202.

An interior surface 208 of the label 200 is covered when the second section 204 is coupled to the fabric cover 104 and the interior surface 208 is uncovered when the second section 204 is uncoupled from the fabric cover 104. In other words, the label 200 is in a closed position where the interior surface 208 is not visible or in an open position where the interior surface 208 is visible. When the label 200 is in the closed position, the label 200 lays substantially flat against the fabric cover 104 and non-obtrusively conforms to the main body 102. The label 200 is formed from a durable material or fabric, e.g., non-functional fabric, and combined with the construction of the first section and the second section, the label 200 is operable to be repeatedly opened and closed without damaging the label 200.

The interior surface 208 comprises a material configured to be written and/or printed on. The interior surface 208 includes information about the toy 101, e.g., collectability information, toy type, toy name, toy profile, limited edition information, etc. In some embodiments, the interior surface 208 is blank to allow for a user to write on the interior surface 208. Alternative embodiments contemplate the interior surface 208 comprising a combination of pre-determined information and a blank surface area for receiving written material to provide for a customizable label 200.

Returning to FIGS. 1A and 1B, the system 100 comprises a second portion 112 comprising a first side and an opposing second side 114. In some embodiments, the first side comprises an adhesive to selectively secure the second portion 112 to an object 116. Alternative embodiments contemplate the second portion 112 being selectively secured to the object 116 by stitching, riveting, or the like. In the illustrated example, shown in FIG. 1A, the second portion 112 is selectively secured by adhesion to the object 116, e.g., a helmet. In other examples, the object 116 is any surface of any object including, but not limited to, a wall, a backpack, an article of clothing, a hat, a cup, or a bag.

The second side 114 comprises the second connectable fabric 105. As previously described, the second connectable fabric 105 is at least one of the hook fabric or the loop fabric. The main body 102 is releasably coupled to the second portion 112 when the first connectable fabric 103 of the fabric cover 104 is joined to the second connectable fabric 105 of the second portion 112. Conversely, the main body 104 is removed from the second portion 112 when the first connectable fabric 103 is pulled away from the second connectable fabric 105. Further, the plush toy 101 is operable to be releasably coupled to or removed from the object 116 repeatedly. Releasably coupling the main body 102 to the second portion 112 allows for a user to couple the plush toy 101 to a variety of objects 116, thereby providing customization and/or personalization of the object 116. Additionally, the plush toy 101 itself is capable of customization and/or personalization.

Figure 3:
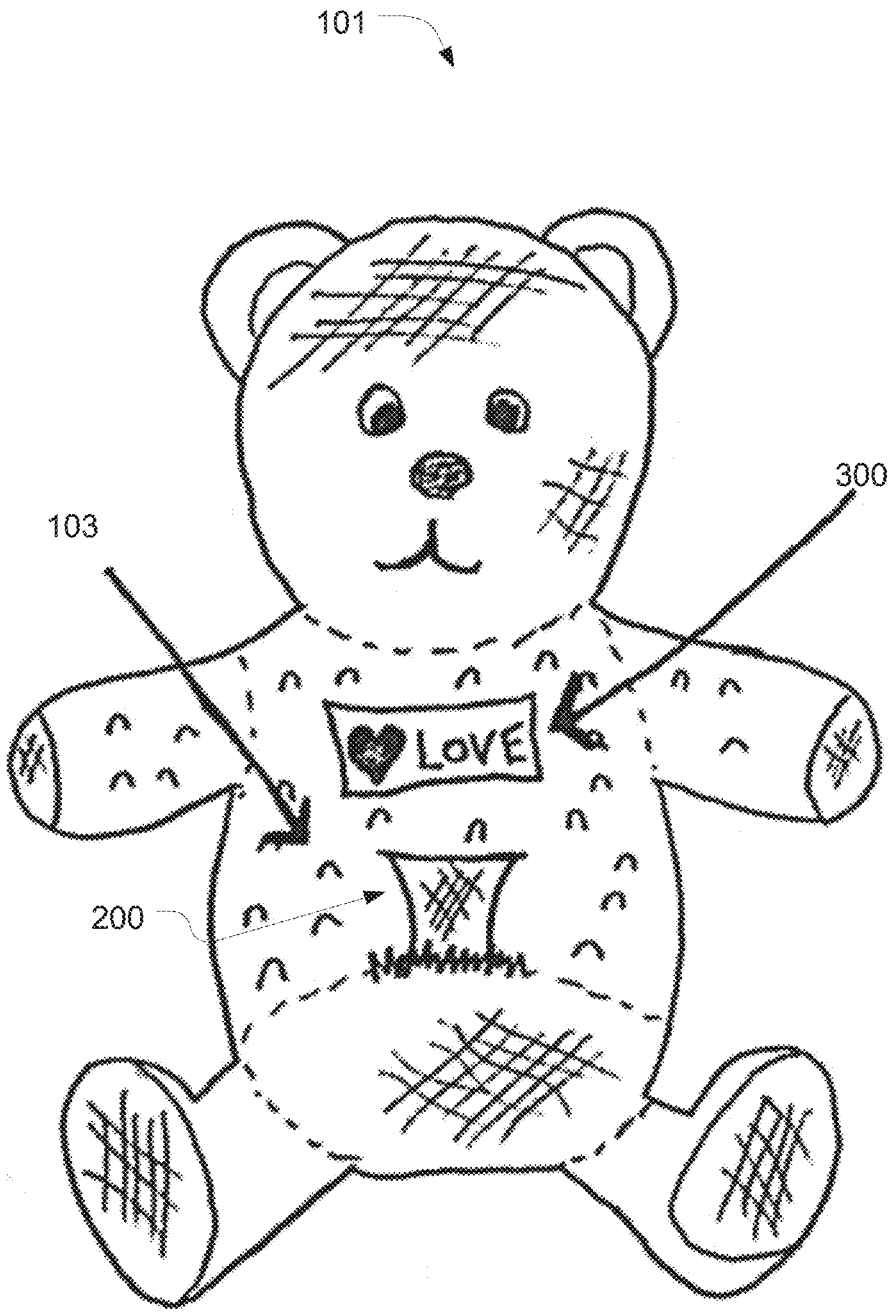
FIG. 3 is a front elevation view of the plush toy of the plush toy system of the embodiment of FIG. 1A.

Turning to FIG. 3, a front elevation view of the plush toy 101 of the plush toy system 100 of the embodiment of FIG. 1A is shown. The system 100 comprises a third portion 300 comprising a surface having the second connectable fabric 105. In the illustrated example, the third portion 300 is a label. Alternative embodiments contemplate the third portion 300 comprising any accessory including, but not limited to, a hat, a pair of sunglasses, a bag, a backpack, an article of clothing, a pen, or the like. The third portion 300 provides for personalization of the plush toy 101 itself by allowing a user to add an accessory to the plush toy 101 unique to the user. For example, a label describing a characteristic of the plush toy and/or the user is operable to be releasably coupled to the plush toy.

Figure 4:
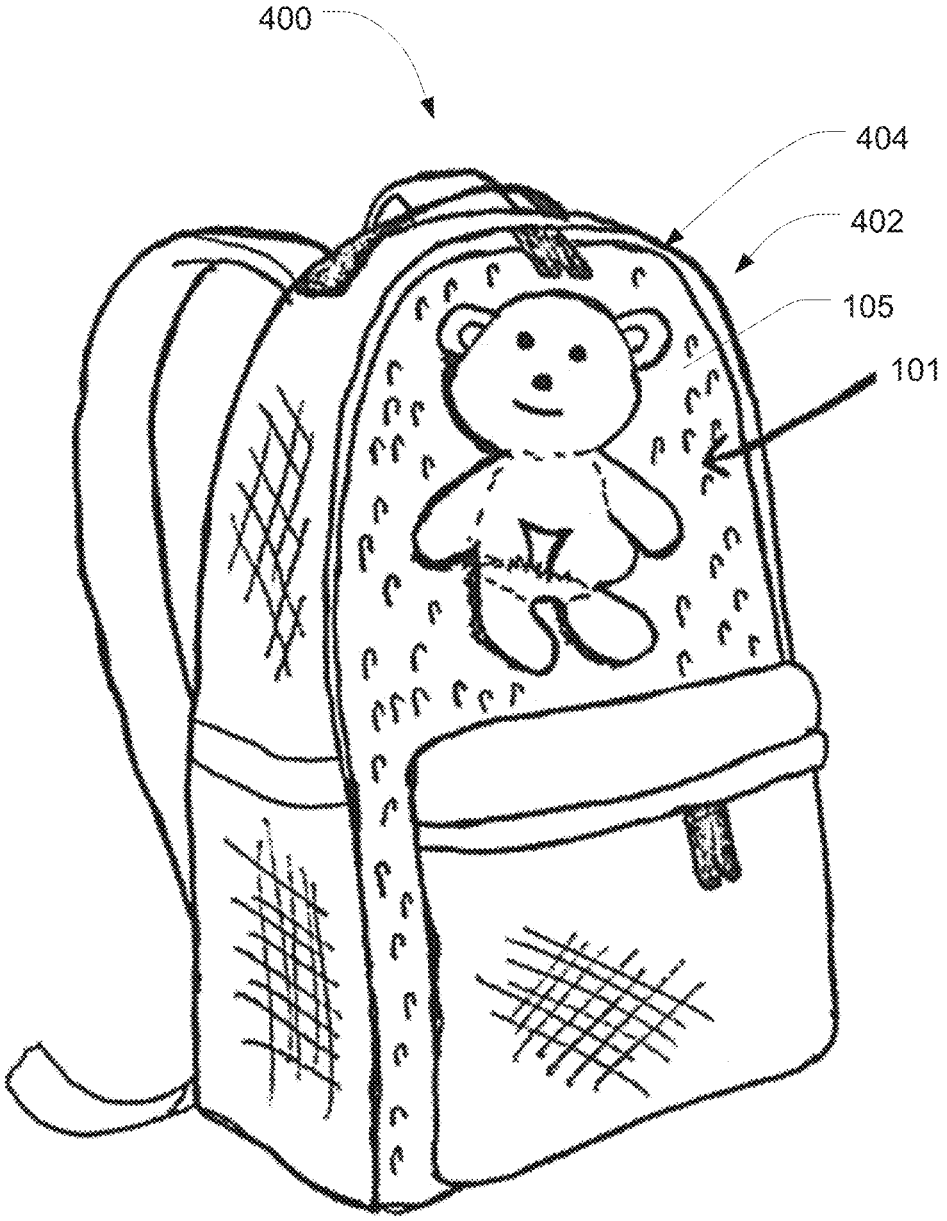
FIG. 4 is a front perspective view of a plush toy system according to one embodiment of the present disclosure.

Turning to FIG. 4, another front perspective view of a plush toy system 400 according to one embodiment of the present disclosure is illustrated. The system 400 includes the plush toy 101 as described with respect to FIGS. 1A-1B and 3 and the label 200 as described with respect to FIGS. 2A-2B.

As shown in FIG. 4, the system 400 further includes an object 402, e.g. a backpack as illustrated. However, in other examples, the object 402 is any surface of any object including, but not limited to, a wall, a backpack, an article of clothing, a hat, a cup, or a bag. The object 402 comprises a second portion 404 comprising the second connectable fabric 105, as described with respect to FIGS. 1A-1B. In other words, the second portion 404 is formed as part of the object 402 or otherwise formed with the object 402. For example, a fabric of a backpack comprises at least one of the hook material or the loop material. In another example, a portion of a jacket comprises at least one of the hook material or the loop material. Thus, the main body 102 is releasably coupled to the object 402 at the second portion 404.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention.

What is claimed is:

1. A plush toy system that is selectively securable to an object, the system comprising:

a main body comprising a fabric cover at least partially defining an enclosed area;

a first portion of the fabric cover comprising a first connectable fabric operable to releasably attach to a second connectable fabric, wherein the first portion comprises at least twenty-five percent of the fabric cover;

wherein the enclosed area comprises a fill material;

a label having a first section fixed to the first portion and a second section removably coupled to the first portion, at least a portion of the second section comprising the second connectable fabric;

wherein the second section is removably coupled to the fabric cover via the second connectable fabric releasably attaching to the first connectable fabric;

wherein an interior surface of the label is covered when the second section is coupled to the fabric cover and the interior surface is uncovered when the second section is uncoupled from the fabric cover; and a second portion comprising a first side and an opposing second side, wherein the first side comprises an adhesive to selectively secure the second portion to an object;

wherein the second side comprises the second connectable fabric;

wherein a toy is releasably coupled to the second portion when the first connectable fabric of the fabric cover is joined to the second connectable fabric, wherein the object is larger than the toy.

2. The plush toy system of claim 1, wherein the interior surface includes information about the toy.

3. The plush toy system of claim 1, wherein the second portion is at least one of a fabric strip, a fabric patch, and a fabric covering.

4. The plush toy system of claim 1, wherein the object is at least one of a wall, a helmet, a backpack, and an article of clothing.

5. The plush toy system of claim 1, wherein each of the first connectable fabric and the second connectable fabric is at least one of a hook fabric and a loop fabric.

6. A plush toy system that is selectively securable to an object, the system comprising:

a main body comprising a fabric cover at least partially defining an enclosed area;

a first portion of the fabric cover comprising a first connectable fabric operable to releasably attach to a second connectable fabric, wherein the first portion comprises at least twenty-five percent of the fabric cover;

wherein the enclosed area comprises a fill material;

a label having a first section fixed to the first portion and a second section, at least a portion of the second section comprising the second connectable fabric;

wherein the second section is removably coupled to the first portion via the second connectable fabric releasably attaching to the first connectable fabric; and an object comprising a second portion;

wherein the second portion comprises the second connectable fabric;

wherein a toy is releasably coupled to the second portion when the first connectable fabric of the fabric cover is joined to the second connectable fabric, wherein the object is larger than the toy.

7. The plush toy system of claim 6, wherein an interior surface of the label is covered when the second section is coupled to the cover and the interior surface is uncovered when the second section is uncoupled from the cover.

8. The plush toy system of claim 7, wherein the interior surface includes a material configured to be written on.

9. The plush toy system of claim 6, wherein the object is at least one of a wall, a backpack, and an article of clothing.

10. The plush toy system of claim 6, wherein each of the first connectable fabric and the second connectable fabric is at least one of a hook fabric and a loop fabric.

11. A plush toy that is selectively securable to an object, the toy comprising:

a main body comprising a fabric cover at least partially defining an enclosed area;

a first portion of the fabric cover comprising a first connectable fabric operable to releasably attach to a second connectable fabric, wherein the first portion comprises at least twenty-five percent of the fabric cover;

wherein the enclosed area comprises a fill material; and a label having a first section fixed to the first portion and a second section removably coupled to the first portion, at least a portion of the second section comprising the second connectable fabric;

wherein the second section is removably coupled to the fabric cover via the second connectable fabric releasably attaching to the first connectable fabric;

wherein an interior surface of the label is covered when the second section is coupled to the cover and the interior surface is uncovered when the second section is removed from the cover.

12. The plush toy of claim 11, wherein the label comprises an interior surface that includes information about the toy.

13. The plush toy of claim 11, wherein the second connectable fabric is disposed on at least one of a wall, a helmet, a backpack, and an article of clothing.

14. The plush toy of claim 11, wherein each of the first connectable fabric and the second connectable fabric is at least one of a hook fabric and a loop fabric.

15. A plush toy system comprising the plush toy of claim 13 and a second portion comprising the second connectable fabric.

16. The plush toy system of claim 15, wherein the second portion is secured to an object, and wherein the object is larger than the toy.

17. The plush toy system of claim 15, wherein the second portion is at least one of a fabric strip, a fabric patch, and a fabric covering.

* * * * *